United States Patent [19]

Nasu

[11] Patent Number: 4,852,992

[45] Date of Patent: Aug. 1, 1989

[54] COMBUSTION AIDS

[76] Inventor: Atsushi Nasu, 99 Katako, Youkaichiba-shi, Chiba-ken, Japan

[21] Appl. No.: 111,657

[22] Filed: Oct. 23, 1987

[30] Foreign Application Priority Data

Oct. 23, 1986 [JP] Japan ..... 61-253478
Dec. 27, 1986 [JP] Japan ..... 61-313996

[51] Int. Cl.[4] ..... C10L 1/00; C10L 1/32
[52] U.S. Cl. ..... 44/50; 44/51
[58] Field of Search ..... 44/50, 51

[56] References Cited

U.S. PATENT DOCUMENTS

| | | | |
|---|---|---|---|
| 58,180 | 12/1866 | Scott | 44/50 |
| 110,054 | 12/1870 | Lipton | 44/50 |
| 2,966,029 | 12/1960 | Rocchini et al. | 44/50 |
| 3,380,531 | 5/1967 | McAuliffee et al. | 166/45 |
| 3,948,617 | 4/1976 | Withorn | 44/50 |

FOREIGN PATENT DOCUMENTS

| | | | |
|---|---|---|---|
| 62-062890 | 3/1987 | Japan | 44/50 |

OTHER PUBLICATIONS

Sekiyu et al, "Removal of $SO_x$ and $NO_x$", 56-15929-1(A), 8-12-1981, Japan.

Shrene, R. N., "The Chemical Engineering Series", Phosphorus Industries, 2nd Ed., McGraw-Hill Book Co. Inc. 1956, N. Y. pp. 388-353 370-371.

*Primary Examiner*—William R. Dixon, Jr.
*Assistant Examiner*—Margaret B. Medley
*Attorney, Agent, or Firm*—Lorusso & Loud

[57] ABSTRACT

The novel combustion aids are fuel additives containing, as their major components, water and the reaction product of a hydrocarbon oil and a strong alkali. The combustion aids are effective for reducing fuel costs and cleaning the exhaust gas of internal combustion engines.

9 Claims, No Drawings

COMBUSTION AIDS

BACKGROUND OF THE INVENTION

1. Field of the Invention

The present invention relates to combustion aids, preferably used for internal combustion engines, especially internal combustion engines such as gasoline engines and diesel engines of the types used in automobiles, etc.

2. Prior Art

In recent years, extensive efforts have been made toward reducing noxious emissions in exhaust gases, e.g. CO, NOx and incompletely combusted hydrocarbons, and reductions in fuel consumption by internal combustion engines. The prior art approaches have focused mainly on: (1) post-treatment of exhaust gas, (2) improvements in combustion chambers and use of evaporators, (3) control of fuel and ignition systems, and (4) stratified combustion methods, etc. In particular, a totalized system using a microcomputer has been developed to integrate control of fuel feed, ignition, the refluxing rate of the exhaust gas and the like, such control being responsive to the operating parameters of the engine.

With the exception of exhaust gas treatments, the aforementioned prior art techniques all relate to improvements in the combustion state by changing and controlling the physical environment for combustion, to thereby make the combustion more efficient and these approaches envision further provision for cleaning of the exhaust gas. In other words, such prior art approaches do not attempt to both improve combustion and to reduce noxious emissions, except to the extent that the latter follows from the former. Techniques for the post-treatment of exhaust gas, in general, fall into one of two categories: (1) cleaning exhaust gas using a catalyst and (2) recirculating a portion of the exhaust gas to the egine. These techniques provide good results in reducing hydrocarbon, CO and NOx emissions. However, even by these techniques, complete combustion is not achieved so that emission of the aforementioned air pollutants remains at an unacceptably high level.

SUMMARY OF THE INVENTION

The above-described drawbacks in the prior art have been successfully eliminated by the present invention.

An object of the present invention is to provide combustion aids which, at the same time, satisfy both the need for cleaning exhaust gas and the need for improving combustion efficiency.

The combustion aids of the present invention are fuel additive compositions containing, as their main components, water as a first component (a) and the reaction product of a hydrocarbon oil and a strong alkali as a second component (b). When admixed with fuel fed to an internal combustion engine, these compositions can prevent formation of acidic pollutants such as CO, NOx and the like in the combustion system, and at the same time, can achieve complete combustion of the fuel.

These and other objects of the present invention will become apparent from the description of preferred embodiments which follows.

DETAILED DESCRIPTION OF PREFERRED EMBODIMENTS

The present invention will be described with reference to the examples to follow below but the invention is not deemed to be limited to such examples, the scope of the invention being indicated by the appended claims.

In the compositions of the present invention, the water (component (a)) may be pure water, rain water, seawater, etc. Seawater is most preferably used because, firstly, seawater is a infinite resource. Secondly, seawater contains trace amounts of various metal ions and it is believed that such metals catalytically aid combustion. Thirdly, the composition of seawater is relatively constant and can be utilized as is. It is preferred that the pH of the water (seawater) be adjusted to strongly alkaline or strongly acidic prior the mixing with component (b), depending upon the intended use. High alkalinity (pH 13 or above) enhances combustion efficiency and, therefore, the highly alkaline compositions of the present invention are particularly suited for use as gasoline additivies. Further in the case of using water or seawater adjusted to strong acidity (pH 2 or less), the miscibility with the second component (b) is good and the obtained combustion aid contains a larger amount of CH components so that the combustion aid is readily compatible with fuel. Such highly acidic compositions can be advantageously used as additives for diesel fuel in which the additivie is employed in a relatively large amount. In other words, in the case of diesel fuels, because of the larger amount of additive employed, compatibility (solubility) with the fuel is a more important factor than in the case of gasoline fuels.

In order to make the water or seawater strongly alkaline one may use the same strong alkali as used to form the second component (b). Suitable strong alkalis include any substance containing calcium oxide as a main component. However, from a practical viewpoint, the alkaline agent is preferably sintered shell, bone, limestone or the like, obtained by sintering at high temperatures of approximately 1000° to 1500° C. This strong alkali is incorporated in an amount of approximately 0.5 to 10%, preferably 1 to 3%, based on the amount of seawater, followed by mixing and stirring. By removing insoluble matters or precipitates, an aqueous solution having a pH of 13 or more can be obtained. For a strongly acidieccomposition, diluted sulfuric acid (pH 0.1 or less) or a particularly adjusted acid (hereinafter referred to as "P-S acid") as described below is added to water or seawater. The terminology "P-S acid" as used herein has reference to an aqueous solution obtained by adding about 5% of concentrated sulfuric acid to a strong electrolyte solution containing calcium phosphate and removing precipitates, resulting in a solution having a pH of 0.1 or less. The water or seawater in which the pH is lowered by addition of the P-S acid provides a good miscibility with the second component (b), i.e. the mixture of the hydrocarbon oil and alkali.

P-S acid or diluted sulfuric acid is added to the water or seawater in an amount of about 5% to adjust its pH to 2 or less. Further, such seawater wherein the pH has been so lowered may also be used for the high pH compositions described herein, by adding a strongly alkaline agent thereto.

As previously noted, the second component (b), is a reaction mixture of the hydrocarbon oil and a strong alkali. The hydrocarbon oil functions to make the combustion auxiliary of the present invention compatible (miscible) with fuels such as gasoline, diesel oil, etc. Petroleum fractions equiavalent to or heavier than the fuel, or the like are employed and they are not necessarily commercially available petroleum fractions but may alternatively be halogen-containing oils. Further, distillates obtained by fractionation (dry distillation) of vinyl resins such as plastics which are industrial wastes, foamed polystyrene, used tires or the like can be effectively utilized and such a source is preferred from the viewpoint of effective utilization of industrial waste. As the strong alkali used for the second component (b), preferred are alkali materials containing calcium oxide as a major component. However, again from a practical viewpoint, there can be used alkaline products obtained by sintering shell, bone, limestone or the like at high temperatures of approximately 1000° to 1500° C. The sintered products of shell or the like at high temperatures are strongly alkaline and contain calcium oxide as a major component. When dissolved in water, such sintered materials give strongly alkaline aqueous solutions having a pH of 13. Component (b) is a powdery or clay-like reaction mixture obtained by mixing the hydrocarbon oil with the strong alkali in a ratio of approximately 1 : 1, adding a small amount of an aqueous solution of the strong alkali agent thereto and stirring the mixture. The blending ratio of the hydrocarbon oil and the strong alkali, while normally approximately 1 : 1, is not limited thereto since the ratio will vary slightly depending upon the type of oil used. The small amount of strong alkali aqueous solution is added to accelerate the reaction of the oil with the dry strong alkali and, the alkali used to form that aqueous solution may be the same strong alkali added to the water to form component (a) and added to the hydrocarbon to form component (b). Where the dry fractionation oils used in component (b) contain water, it is unnecessary to add water in the preparation of (b).

The composition of the combustion aid containing components (a) and (b) is such that component (b) is 0.5 to 10% of the total sum of both components. The composition varies depending upon whether the water in the first component (a) is alkaline or acidio in nature and also varies depending upon the type of fuel used. However, when the second component (b) is less than 0.5% or exceeds 10%, the objective of the prevent invention of producing almost complete combustion cannot be achieved.

The reaction mixture of component (b) is a fine powder which is readily scattered. For prevention of scattering, a small amount of an alcohol may also be added. By the addition of alcohol, the component (b) is not only prevented from scattering but is also rendered more readily soluble in the component (a).

For supplying the combustion aid of the present invention to gasoline engines or diesel engines of automobiles or the like, a separate container or tank for holding the combustion aid may be mounted in the engine compartment and fed through a fuel tube, in timing with intake, into a cylinder while controlling the feed responsive to selected engine operating parameters. However, the method is not limited thereto.

The amount of the combustion aid to be added to the fuel is 0.1 to 5%, preferably 0.3 to 1% in the case of gasoline; and in the case of diesel fuel, it is 1 to 15%, preferably 5 to 15%. However, it is preferred to vary the amount of combustion aid added responsive to the rpm and temperature of the engine and the amount added is not limited to the numerical range mentioned above.

The combustion aid of the present invention greatly improves the state of combustion and, at the same time, enables improvement in fuel costs and reduction of formation of air pollutants such as NOx or the like. Further, the combustion aid of the present invention utilizes seawater, which is an infinite resource, substances such as shell, bone, limestone, etc. which occur widely in nature and industrial wastes such as plastics, used tires, etc. so that production costs are very low. In addition, in the sense that pollution is reduced by utilizing such useless substances as seawater, shell, industrial wastes, etc. the present invention is epoch-making.

EXAMPLE 1

Shells such as scallops, etc. are washed with water and then crushed. The crushed shells were charged into a furnace and sintered at 1000° to 1200° C. for about 30 minutes. Then the temperature was raised to about 1350° C. and sintering was performed for an additional 5 to 10 minutes to give a powdery strong alkali of about 200 mesh.

To 1000 cc of seawater was added 20 g of that strong alkali. After stirring for about an hour, precipitates were removed to give a solution (a).

To form a component (b), 500 g of the strong alkali described above was added to 500 cc of fractionated oil of used tires and, 100 cc of an aqueous solution of strong alkali was further added to the mixture. After stirring, the mixture was allowed to stand for 30 minutes under about 2 atms. to give a powdery reaction mixture (b).

After stirring 1000 cc of the solution (a) and 30 g of the reaction mixture (b) in a reactor under 1.5 atms. at room temperature for about an hour, the mixture was allowed to stand almost overnight. Insoluble matters were removed to give a combustion aid in the form of a homogeneous liquid.

EXAMPLE 2

50 g of a powder composed mainly of calcium phosphate obtained by sintering animal bones was dissolved in 1 liter of pure water. Then 5% of conc. sulfuric acid was added to the aqueous solution to give a strongly acidic aqueous solution having pH of 0.2 (P-S acid).

To 500 liters of seawater was added 10 liters of the P-S acid described above. After allowing to stand for 3 hours, impurities were filtered off. As a result, the seawater had a pH of 1.6. Then, 3% of sodium hydroxide was added to the seawater. After allowing to stand overnight, precipitates were removed to give an aqueous solution (a) having a pH of 13.7.

4 kg of sintered lime was added to 6 kg of dry distillation oil of vinyl chloride to give a powdery reaction mixture (b). In this case, sufficient water was present in the dry distillation oil which was used for the reaction so that it was unnecessary to add water to form component (b).

After mixing and stirring 150 liters of the aqueous solution (a), 15 kg of the reaction mixture (b) and 750 cc of ethanol under conditions similar to Example 1, insoluble matter was removed to produce a combustion aid.

EXAMPLE 3

An aqueous solution (a) was obtained in a manner similar to Example 2.

5 kg of sintered lime and 1000 cc of water were mixed with 5 kg of a heavy oil to give a powdery reaction mixture (b).

After mixing and stirring the aqueous solution (a), the reaction mixture (b) and 500 cc of ethanol under conditions similar to Example 1, insoluble matter was removed to produce a combustion aid.

TABLE 1

| | Example 1 | Example 2 | Example 3 | Comparative Example |
|---|---|---|---|---|
| HC (ppm) | 20 | 20 | 20 | 200 |
| CO (%) | 0.01 | 0.01 | 0.01 | 0.1 |
| NOx (%) | 13 | 13 | 13 | 34 |

A combustion aid addition system using a computer was mounted in a gasoline car (Nissan, E-H 252), which was designed to inject the combustion aid of the present invention through a computer controlled nozzle mounted to an intake manifold of each cylinder of the engine, when an intake valve was opened. After the computer system was set, HC, NOx and CO in the waste gas after running 7294 km were analyzed. The results are shown in Table 1.

As a Comparative Example, the results of analysis of the waste gas from an automobile of the same brand using no combustion aid at all are shown in Table 1.

Further, the combustion aid prepared in Example 2 was fed to a gasoline car 1 (Nissan, E-H 252), gasoline car 2 (Toyota Crown, 1981), diesel car 1 (Nissan Cedric) and diesel car 2 (Mitsubishi, 3 ton truck, 1978). Running tests were conducted to test fuel efficiency. The results are shown in Table 2, as compared to the control using no combustion aid. In all cases fuel efficiency was improved by more than 25%, as compared with using no combustion aid.

TABLE 2

| Fuel Efficiency (km/1) | Gasoline car 2 | Gasoline car 2 | Diesel car 1 | Diesel car 2 |
|---|---|---|---|---|
| No combustion aid | 4.8 | 7.9 | 7.8 | 4.75 |
| Combustion aid | 6.9 | 9.5 | 12.1 | 6.42 |
| (Amount used for fuel, %) | (0.1) | (3) | (5) | (10) |

Condensables exiting the mufflers of these automobiles were analyzed. As a result, elements such as sodium, calcium, etc. were detected in larger amounts in all cases but there was no abnormal finding in the engine oils after running for 7500 km.

Thus, there is provided in accordance with the invention a combustion aid which offers the advantages discussed above. The embodiments described above are intended to be merely exemplary and those skilled in the art will be able to make variations and modifications without departing from the spirit and scope of the invention. All such modifications and variations are contemplated as falling within the scope of the claims.

What is claimed is:

1. A combustion aid, in the form of an aqueous alkaline solution, comprising (a) water and (b), dissolved in said water, the product obtained by treating a hydrocarbon oil with an alkali, wherein the amount of said product (b) is 0.5–10% of the total of (a) and (b).

2. A combustion aid in accordance with claim 1 wherein said alkali is obtained by sintering a naturally occurring substance of a high calcium content selected from the group consisting of shell, bone, limestone and mixtures thereof.

3. A combustion aid in accordance with claim 1 wherein said water is seawater.

4. A combustion aid in accordance with claim 1 additionally comprising an alkali and having a pH of at least 13.

5. A combustion aid in accordance with claim 4 wherein said alkali is obtained by sintering a naturally occurring substance of high calcium content selected from the group consisting of shell, bone, limestone and mixtures thereof.

6. A combustion aid in accordance with claim 3 wherein said seawater is treated by addition of an acid to produce an acidic pH, followed by addition of an alkali to produce an alkaline pH.

7. A combustion aid in accordance with claim 6 wherein said acid is obtained by dissolving a sintered product of a bone, having calcium phosphate as its major component, in water and adding about 5% of concentrated sulfuric acid to the aqueous solution.

8. A combustion aid in accordance with claim 1 wherein said product (b) is formed as a powder and then dissolved in said water.

9. A combustion aid in accordance with claim 1 wherein the ratio of said alkali to said hydrocarbon oil is approximately 1:1.

* * * * *

UNITED STATES PATENT AND TRADEMARK OFFICE

CERTIFICATE OF CORRECTION

PATENT NO. : 4,852,992

DATED : August 1, 1989

INVENTOR(S) : Atsushi NASU

It is certified that error appears in the above-identified patent and that said Letters Patent is hereby corrected as shown below:

Col. 2, line 48, "acidieccomposition" should read --acidic composition--.

Col. 3, line 4, "equiavalent" should read --equivalent--; and line 44, "acidio" should read --acidic--.

Signed and Sealed this

Twenty-sixth Day of November, 1991

*Attest:*

HARRY F. MANBECK, JR.

*Attesting Officer*

*Commissioner of Patents and Trademarks*